United States Patent [19]

Hucal

[11] 4,429,786

[45] Feb. 7, 1984

[54] INTEGRATED CONTACT LENS-MAINTENANCE KIT CARRYING APPARATUS

[76] Inventor: Stephen J. Hucal, 535 N. Michigan Ave., Chicago, Ill. 60611

[21] Appl. No.: 429,325

[22] Filed: Sep. 30, 1982

[51] Int. Cl.[3] ..... B65D 21/02; B65D 85/62; A45C 11/04

[52] U.S. Cl. ..... 206/5.1; 206/499; 206/537; 215/6; 220/4 D

[58] Field of Search ..... 206/5.1, 38, 37, 537, 206/499; 220/4 D; 215/6

[56] References Cited

U.S. PATENT DOCUMENTS

| | | | |
|---|---|---|---|
| 2,663,450 | 12/1953 | Bourcart | 220/4 D |
| 2,707,552 | 5/1955 | Matthiesen | 206/537 |
| 2,759,598 | 8/1956 | Tregilgas | 206/537 |
| 2,940,589 | 6/1960 | Silverman | 206/5.1 |
| 4,036,357 | 7/1977 | Czelen | 206/5.1 |

*Primary Examiner*—William T. Dixson, Jr.
*Attorney, Agent, or Firm*—Dick and Harris

[57] ABSTRACT

An integrated contact lens and maintenance kit carrying apparatus for the portable facilitated storage and carrying of a user's contact lenses as well as a plurality of fluids normally utilized with such contact lenses. Two lens storage elements are operably connected with a plurality of fluid containers into an overall thin substantially cylindrical elongated configuration. The peripheral portions of the fluid containers and lens storage modules form the substantially cylindrical configuration of the apparatus periphery. The device includes indicia means associated with the lens storage modules and the fluid containers for facilitated identification and selection of the fluids or lens eyes associated therewith.

18 Claims, 5 Drawing Figures

INTEGRATED CONTACT LENS-MAINTENANCE KIT CARRYING APPARATUS

BACKGROUND OF THE INVENTION

The present invention relates, in general, to health and hygiene products and particularly to a fluid-tight contact lens storage and maintenance kit carrying case for the facilitated and convenient carrying of a user's contact lens equipment.

With the relatively recent advent of both soft and hard contact lenses, a myriad of carrying cases, applicators and kits have been developed for the facilitated carrying of the contact lenses themselves or one particular fluid utilized therewith.

While a myriad of devices exist such as those disclosed by U.S. Pat. Nos. 2,940,589; 4,036,357; 3,880,278; 4,308,947 as well as the disposable shaving kit of U.S. Pat. No. 2,818,872, few, if any, of these devices have addressed such an integrated contact lens and lens maintenance kit which is capable of transporting, in a completely integrated manner, all of the fluids frequently utilized by a user for the care, storage and maintenance of the user's contact lenses, together with the lenses.

It is thus an object of the present invention to provide such a contact lens-maintenance kit carrying apparatus which maintains all the needed fluids required by a user in an integrated construction, together with the user's contact lenses themselves through a secure construction which may be utilized in a facilitated manner, as needed.

Another object of the invention is to provide such an apparatus which is inexpensive to fabricate, but which, at the same time, permits the facilitated identification and selection of a desired fluid or contact lens from the apparatus, while maintaining its relatively small portable configuration for carrying via pocket or purse.

It is additionally an object of the present invention to provide for such an integrated apparatus which permits refilling of the fluid container elements therewithin while providing a mirror for convenience and a clip for carrying as a "pen-like" structure in a user's pocket.

Yet another object of the invention is to provide for such a portable, integrated carrying apparatus which is capable of maximizing the amount of storage space for the liquids contained therein within an elongated substantially cylindrical construction—all in a liquid-tight environment for the fluids contained within the fluid containers as well as the storage liquids contained within the contact lens storage modules.

These and other objects of the invention will become apparent in light of the present specification and drawings.

SUMMARY OF THE INVENTION

The present invention comprises an integrated contact lens and lens maintenance kit carrying apparatus for the portable facilitated storage of a user's contact lenses as well as the storage and carrying of a plurality of fluids utilized for the wearing and maintenance of the contact lens. The apparatus comprises two lens storage means for the receipt and storage of each one of the contact lenses with each of the storage means being capable of removably receiving each of the respective contact lenses while maintaining the contact lenses, when stored therein, in a liquid-tight storage fluid environment.

In the apparatus, the two lenses are positioned so as to be over one another relative to the longitudinal axis of the apparatus while substantially concentrically positioned along said axis.

A plurality of fluid container means are positioned along the longtitudinal axis of the apparatus so as to be removably and operably attached to one or more of the lens storage means by container attachment means. Each of these fluid containers are juxtapositioned to one another and contain fluids utilized for the user's wearing and maintenance of the contact lenses. Further, each of the fluid containers and lens storage means are integrated into a substantially elongated thin cylindrical configuration to facilitate the portable carrying of same in a user's pocket or purse. Each of the fluid containers themselves further utilize a peripheral portion of their structure to form a substantial peripheral portion of the actual thin cylindrical configuration ascribed to the overall apparatus. Additionally, each of the fluid containers relies upon a fluid release and containment element which alternatively releases or locks in the fluid being contained within the fluid container structure.

The fluid container and lens storage means further rely upon indicia means associated therewith to facilitate the identification of the fluids and the lenses respectively contained thereby.

In an alternative preferred embodiment the invention further comprises apparatus housing means comprising a substantially elongated cylindrical sleeve conforming in peripheral shape to the collective peripheral shapes of the fluid containers and lens storage means so as to substantially and closely slidingly enclose same through telescopic receipt thereabout. In one embodiment of this construction, the cylindrical sleeve is slotted along a longitudinal side and the fluid containers and lens storage means have tabbed selection elements emanating radially from each for cooperating sliding receipt within the slot to facilitate the identification, selection and removal of a particular one of the fluid containers or lens storage modules within the apparatus.

The fluid container means, in one embodiment, are all operably interposed between oppositely positioned ones of the contact lens storage means. Through such a construction a user can quickly and efficiently refer to either end of the apparatus for actual removal or storage of either one of the contact lenses. In yet another embodiment of the invention, the plurality of fluid container means are operably and removably attached to one another and, in turn, operably and removably attached to one of the two lens storage modules. In this particular configuration both of the lens storage means are adjacent to one another with the remaining containers collectively attached to one another and attached to the adjacent one of the contact lens storage modules.

In a preferred embodiment of the invention, the fluid container means are substantially and continuously cylindrical in shape with the tops of respective ones of the fluid containers being operably attached in successive head-to-toe fashion with the respective bottoms of immediately adjacent fluid storage containers. In this particular embodiment the fluid is releasable from the respective container storing it through container aperture means located at the top of the fluid container. The fluid is restrainably concealed within its respective fluid container in a liquid-tight manner by the respective bottom of the immediately adjacent juxtaposed fluid container. In this construction, successive ones of adjacent fluid container tops and bottoms are attachable to one another to effectuate the liquid-tight seal through the utilization of interference fit snap elements. In yet another embodiment of the invention, successive ones of adjacent container tops and bottoms are attachable to one another to maintain this liquid-tight seal through the utilization of mated, threaded elements operably positioned proximate to the peripheries of the respective top and bottom portions.

In yet another preferred embodiment of the invention, the fluid container means are radially arranged cylindrical segments positioned and juxtaposed in a side-by-side relationship within the apparatus housing. In this configuration as well as others, each of the fluid containers is fabricated of a substantially resilient plastic material and is telescopically removable from the housing to permit dispensing of the fluid therewithin through the squeezing of same. The inner periphery of the apparatus housing is immediately and continuously juxtaposed to the outer cylindrical peripheral portions of the fluid containers positioned therewithin. Additionally, the alternative release and sealing of fluid within the fluid containers is accomplished through the utilization of pivotable rocker valve means positioned along the top side of each of the "side-by-side" fluid containers wherein the pivotal rocker valve elements themselves serve as handle tabs to permit the facilitated telescopic removal of the fluid containers from within the apparatus housing enclosing them. Preferably the apparatus housing further includes compartment formation means for effectively radially separating the position of the fluid containers therewithin while at the same time facilitating the removal of such side-by-side fluid containers and the reinsertion back into the housing.

The preferred embodiment of the invention includes the utilization of mirror means, preferably adjacent to one or both of the lens storage means, to facilitate the affixation of the lenses onto the eyes of the user. Additionally, pocket clip means are fabricated into the overall apparatus to facilitate the affixation of the apparatus to a users pocket much in the same way as a pen clip.

In one embodiment of the invention the indicia means on the lens storage means and/or fluid container means comprises alphabetical symbols while in another embodiment said indicia means comprises color symbols which would be easily recognizable by a user as identifying the particular type of fluid contained therewithin or the particular right or left eye onto which a particular contact lens is to be placed. As previously mentioned, the apparatus is capable of storing and portably carrying a myriad of contact lens solutions including soaking solution, wetting solution, lubricating solution and/or cleansing solution, among others. In either embodiment of the invention, that in which successive head-to-toe placement of the fluid containers is utilized or in which a side-by-side fluid container arrangement is called for, the fluid may be alternatively removably maintained within the fluid container by cap means which are operably attachable and removable from the individual fluid containers to alternatively maintain a liquid-tight environment or to release the container fluid from within the fluid container means. Additionally, in another embodiment of the invention, the apparatus contemplates the fluid container means being capable of permitting the refilling of the fluid containers with the respective fluids normally contained therewithin, upon depletion of that fluid.

DETAILED DESCRIPTION OF THE DRAWINGS

Figure 1:
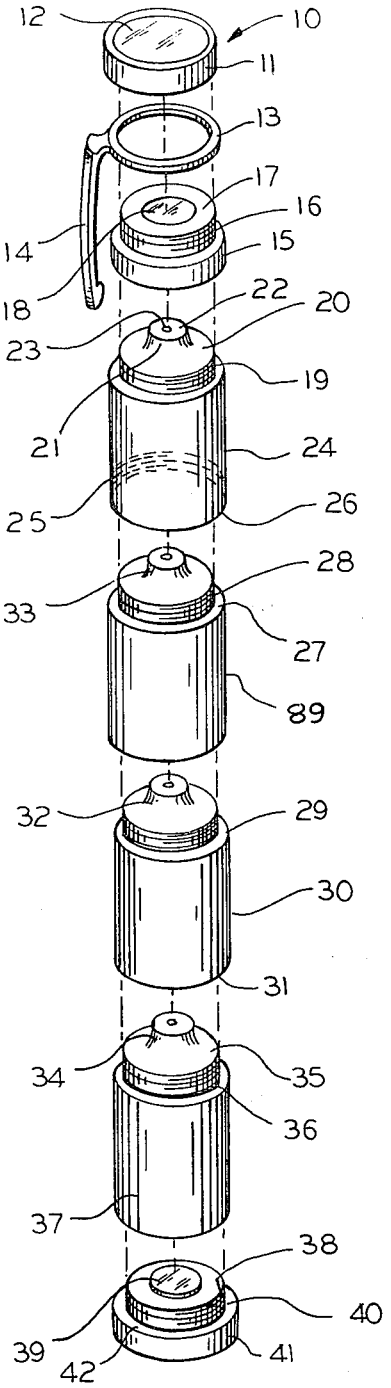
FIG. 1 is a top perspective exploded view of one embodiment of the contact lens-maintenance kit carrying apparatus showing particularly the plurality of fluid container means attached to one another in successive head-to-toe fashion with the lens storage means located at opposite ends of the overall apparatus.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Contact lens and maintenance kit carrying apparatus 10 is shown in FIG. 1 as comprising lens storage modules 41 and 15 at opposite ends of the apparatus as well as fluid containers 37, 30, 89, and 24 arranged in successive head-to-toe fashion between storage module 41 and storage module 15, in which contact lenses 39 and 18 are removably positioned, when not in use, for storage within a fluid storage environment. Contact lens storage module 41 with shoulder 40 and threading 38 is threadedly received by an equivalently mated thread in the bottom of fluid container 37. In like fashion, storage module 15 with threads 16 and bowl surface 17 are threadedly received within a mated threaded element within cap portion 11 of apparatus 10. In this particular embodiment, cap portion 11 further includes mirror 12 for facilitating the affixation of the contact lenses by the user over said user's eyes.

Further threaded attachment of the component parts of the apparatus is relied upon for affixing the head-to-toe arranged fluid containers 37, 30, 89, and 24 together into a single integrated apparatus while at the same time permitting the removal and exposure of the top portion of any one of the fluid containers for release of the fluid contained therein. Threads 36, for example, on fluid container 37 are threadingly received by equivalently mated threading on bottom 31 of fluid container 30. Similarly, the threaded portion of fluid container 30 is received by the bottom portion of fluid container 89, and the threaded portion of fluid container 89 is threadedly received by the equivalently mated threads 25 on fluid container 24. In this particular embodiment, fluid container 24 connects directly through threaded receipt into equivalent threading in contact lens storage module 15. Also shown in FIG. 1 is pocket clip 13 which, in this embodiment, is restrainably positioned between shoulder 16 of lens module 15 and cap 11.

The particular embodiment of FIG. 1 does not rely upon an additional apparatus housing but rather relies upon the individual components of the apparatus to form, upon connection, into the substantially elongated cylindrical apparatus for purse or pocket. Preferably, the component parts are identified with either letters, numbers or colors to assist the user in determining which fluid is contained by which fluid container as well as determining upon which eye a particular lens fits. In use, a user would simply unscrew the particular container from which fluid is desired, from its immediately adjacent container and then squeeze the desired fluid from that container. Moreover, in the preferred embodiment, fluid container tops such as container top 32 on fluid container 30 is snappedly removabl so as to permit the refilling of fluid container 30 when the fluid content therewithin is depleted.

Figure 2:
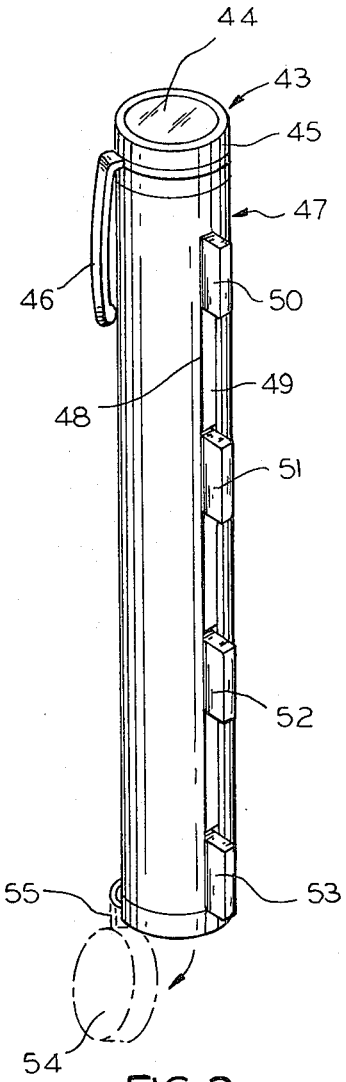
FIG. 2 is a top perspective view of another embodiment of the invention in which apparatus housing means are utilized with a slotted portion therewithin to receive and cooperate with radially emanating tabs from one or more of the fluid containers or lens storage modules.

In FIG. 2 of the drawings, apparatus 43 is shown as an alternative embodiment, in which apparatus housing 47 comprises a substantially thin elongated cylindrical sleeve in which the substantially cylindrically shaped components of the apparatus are telescopically received. Housing 47 includes slotted portion 48 for the cooperating receipt of tabs such as tabs 50, 51, 52 and 53 which radially emanate outwardly from particular ones of the apparatus fluid containers and/or contact lens storage modules such as tab 50 emanating from fluid container 49. In this particular embodiment the component fluid containers and contact lens storage modules are arranged as shown in FIG. 1 in head-to-toe fashion. Also shown in FIG. 2 is housing bottom cap 54 pivoting at hinge 55 as well as upper cap 45 with mirror 44 fabricated thereupon. The invention contemplates utilization of caps 45 and 54 independently of the lens storage modules, or as the lens storage modules themselves.

Figure 3:
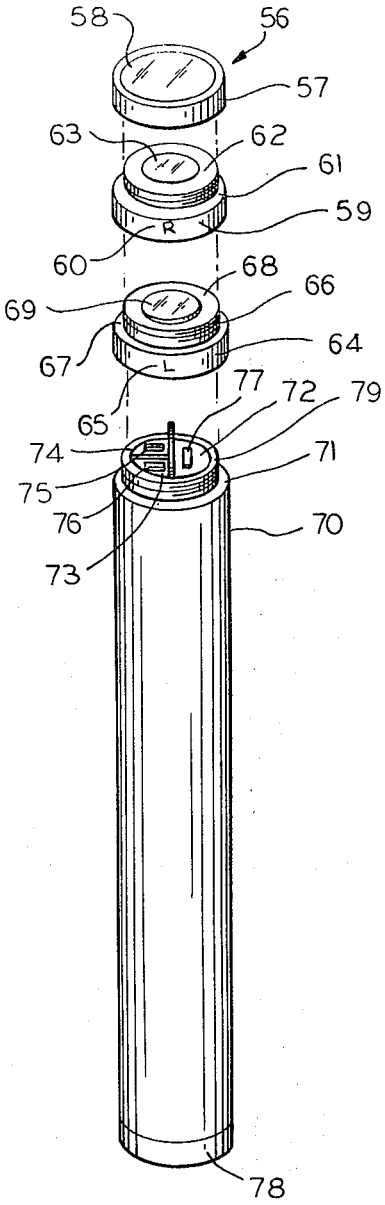
FIG. 3 is a top perspective exploded view of another embodiment of the invention in which the fluid container means are arranged in side-by-side fashion within the apparatus housing with the peripheral shape of the juxtaposed fluid containers closely approximating the substantially elongated cylindrical shape of the housing.
Figure 4:
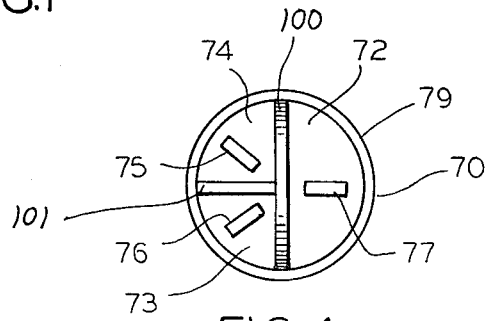
FIG. 4 is a top plan view of the apparatus of FIG. 3 showing particularly the fluid release means associated with the respective fluid compartments therewithin.

An alternative embodiment of the invention is shown in FIG. 3 in which the fluid container means are arranged in side-by-side relationship within container housing 70. Bottom cap 78 and top cap 57 is threadedly fastened in apparatus 56 to integrate fluid containers 72, 73 and 74 as well as storage modules 64 and 59. Storage module 64 shows utilization of alphabetic indicia 65 to designate that that particular module is storing the contact lens 69 for the user's left eye while in like fashion, indicia 60 on storage module 59 shows utilization of that storage module for storage of the right lens 63 maintained in bowl portion 62. Fluid containers 72, 73 and 74 with pivotable valve tops 77, 76 and 75 respectively are arranged in side-by-side fashion within housing 70 so as to have their peripheral portions immediately and substantially juxtaposed to the inner periphery of housing 70. Each one of these fluid containers may be removed at will by pivoting the valve head to its vertically orientated "open" position and pulling on same to withdraw the fluid container attached thereto. Alternatively, compartment element 100 and 101 as shown in FIG. 4, as well, may be permitted to slidingly reciprocate within housing 70 with a disc-like bottom to withdraw all the containers at one time upon the withdrawal of protruding compartment portion 100.

Figure 5:
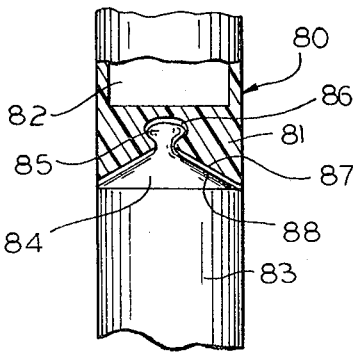
FIG. 5 is a front elevational view, partially in section, showing the manner in which successive ones of fluid containers in the "head-to-toe" configuration are capable of alternatively sealing or releasing fluid from within a particular container by utilization of the bottom of one successive container to seal, through interference fit and snap connectors, the otherwise exposed top surface of an adjoining equivalently shaped fluid container.

An alternative means for attaching head-to-toe arranged fluid container tops to successive fluid container bottoms is shown in FIG. 5 wherein, instead of relying upon the utilization of threaded fasteners as shown in FIG. 1, interference fit snap connectors such as male connector 85 with female receiving portions 86 are utilized in apparatus 80 to connect the bottom 81 of fluid container 82 to the top 84 of fluid container 83 with shoulder portions 88 and 87 on the top and bottom portions respectively mated in configuration to virtually nest.

It is additionally anticipated that a myriad of fastening and connector means may be utilized to connect either head-to-toe arranged fluid containers or side-by-side arranged fluid containers into close proximity with one another. Connectors such as bayonet connectors and clips of various configuration may be so utilized. In such embodiments where the connection means between the fluid containers is segregated from the means for maintaining the liquid within the fluid container in a liquid-tight environment, separate caps are contemplated for use, to independently cover the fluid container elements within the apparatus.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

For example, the invention contemplates as being within its scope, the integration of the housing means with the side-by-side fluid containers into one integral unit (such as through, e.g., molding), as well as the use of clips, bands, cases or other equivalents to the housing means for maintaining the fluid containers in this side-by-side position.

What is claimed is:

1. An integrated contact lens and maintenance kit carrying apparatus for the portable facilitated storage of a user's contact lenses as well as a plurality of fluids for the maintenance of said contact lenses, said apparatus comprising:

two lens storage means for the receipt and storage of each one of a pair of contact lenses;

each of said lens storage means capable of removably receiving one each of said pair of contact lenses as well as maintaining each of said lenses in a liquid-tight storage fluid environment;

a first of said two lens storage means being operably positioned over the second of said lens storage means so as to be substantially concentrically positioned thereabove along the longitudinal axis of said apparatus;

a plurality of fluid container means operably and removably maintained along said longitudinal axis of said apparatus and operably attached to one or more of said lens storage means by container attachment means;

each of said fluid container means being juxtaposed in position to one or more successive ones of said fluid container means and removably containing fluids utilized for said user's wearing and maintenance of said contact lenses;

each of said fluid container means and said lens storage means being integrated into a substantially elongated thin cylindrical configuration to facilitate the portable carrying of same in a user's pocket and purse;

each of said fluid container means having a peripheral portion thereabout forming a substantial peripheral portion of said thin cylindrical configuration;

each of said fluid container means possessing alternative fluid release and containment means associated therewith; and each of said fluid container means and lens storage means further having indicia means associated therewith to facilitate the identification of said fluids and lenses respectively contained thereby.

2. The contact lens and maintenance kit apparatus according to claim 1 in which the invention further comprises apparatus housing means:

said housing means comprising a substantially elongated cylindrical sleeve conforming in peripheral shape to the collective peripheral shapes of said one or more said fluid container means and lens storage means so as to substantially and closely slidingly enclose same through telescopic receipt thereover.

3. The invention according to claim 2 in which at least a portion of said cylindrical sleeve is slotted along a longitudinal side thereof:

one or more of said fluid container means and lens storage means having tabbed selection elements emanating radially therefrom for cooperative sliding receipt by said slot within said sleeve, to facilitate the identification, selection and removal of same from within said housing means.

4. The invention according to claim 1 in which said plurality of fluid container means are operably interposed between respective ones of said two contact lens storage means positioned at opposite ends of said apparatus.

5. The invention according to claim 1 in which each of said lens storage means are positioned immediately juxtaposed to one another:

said plurality of fluid container means being operably and removably attached to one another and, in turn, operably and removably attached to one of said two lens storage means.

6. The invention according to claim 1 in which each of said fluid container means is of a substantially continuous cylindrical shape:

the tops of respective ones of said fluid container being operably attached in successive head-to-toe fashion with the respective bottoms of immediately adjacent fluid storage container means.

7. The invention according to claim 6 in which said respective fluid within each of said fluid container means is releasable from said respective container means through container aperture means at the top end of said fluid container means:

said fluid being restrainably sealed within each of said respective fluid container means in a liquid-tight manner by the respective bottoms of said immediately adjacent juxtaposed fluid container means.

8. The invention according to claim 7 in which successive ones of adjacent fluid container tops and bottoms are attachable to one another to effectuate said liquid-tight seal through snap elements.

9. The invention according to claim 7 in which successive ones of adjacent fluid container tops and bottoms are attachable to one another to effectuate said liquid-tight seal through mated threaded elements operably positioned proximate to the peripheries of said respective top and bottom portions.

10. The invention according to claim 2 in which each of said fluid container means comprises a radially arranged cylindrical segment positioned and juxtaposed in side-by-side relationship within said apparatus housing means:

each of said fluid container means fabricated of a substantially plastic resilient material and telescopically removable from said housing means to permit dispensing of said respective fluid therewithin through the squeezing of same;

the inner periphery of said apparatus housing means being immediately and continuously juxtaposed to the outer cylindrical peripheral portions of said fluid container means as positioned therewithin said apparatus housing means.

11. The invention according to claim 10 in which the alternative release and sealing of fluid within said fluid container means is accomplished through pivotable rocker valve means positioned along the top side of each of said side-by-side positioned fluid container means:

said pivotable rocker valve further serving as a handle tab to permit the telescopic removal of each said fluid container means from within said apparatus housing means.

12. The invention according to claim 10 in which said apparatus housing includes compartment formation means for effectively radially separating the positions of said fluid container means therewithin.

13. The integrated contact lens and maintenance kit carrying apparatus according to claim 1 in which the invention further comprises mirror means to facilitate the affixation of said lenses onto the eyes of said user.

14. The integrated contact lens and maintenance kit carrying apparatus according to claim 1 in which the invention further comprises pocket-clip means to facilitate the affixation of said apparatus to a user's pocket.

15. The invention according to claim 1 in which said indicia means comprises alphabetical symbols.

16. The invention according to claim 1 in which said indicia means comprises color symbols.

17. The invention according to claim 1 wherein said fluid is removably maintained within said fluid container means by cap means operably attachable thereto and removable therefrom to respectively maintain and release said container fluid from within said fluid container means.

18. The invention according to claim 1 in which one of more of said plurality of fluid container means includes means to facilitate the refilling of said fluid container means with a fluid upon depletion thereof.

* * * * *